US008974151B2

(12) United States Patent
He

(10) Patent No.: US 8,974,151 B2
(45) Date of Patent: Mar. 10, 2015

(54) CONSTANT-RESISTANCE LARGE-DEFORMATION ANCHOR ROD

(71) Applicant: Manchao He, Beijing (CN)

(72) Inventor: Manchao He, Beijing (CN)

( * ) Notice: Subject to any disclaimer, the term of this patent is extended or adjusted under 35 U.S.C. 154(b) by 0 days.

(21) Appl. No.: 13/710,220

(22) Filed: Dec. 10, 2012

(65) Prior Publication Data

US 2013/0115013 A1 May 9, 2013

Related U.S. Application Data

(63) Continuation of application No. PCT/CN2011/000060, filed on Jan. 14, 2011.

(30) Foreign Application Priority Data

Jun. 10, 2010 (CN) ..... 2010 1 0196197

(51) Int. Cl.
*E21D 21/00* (2006.01)
*E02D 5/74* (2006.01)
*E02D 5/80* (2006.01)

(52) U.S. Cl.
CPC ..... *E21D 21/0033* (2013.01); *E02D 5/74* (2013.01); *E02D 5/80* (2013.01); *E21D 21/00* (2013.01); *E21D 21/008* (2013.01)
USPC ..... 405/259.3

(58) Field of Classification Search
USPC ..... 405/259.3, 259.1, 258.1, 272, 288, 405/259.2, 259.4–6; 411/6, 15
See application file for complete search history.

(56) References Cited

U.S. PATENT DOCUMENTS

| | | | | |
|---|---|---|---|---|
| 4,848,971 | A * | 7/1989 | Price Jr. | 405/259.3 |
| 4,952,096 | A * | 8/1990 | McCartney | 405/259.3 |
| 4,984,937 | A * | 1/1991 | Karpellus | 405/259.3 |
| 5,259,703 | A * | 11/1993 | Gillespie | 405/259.6 |
| 7,918,879 | B2 * | 4/2011 | Yeung et al. | 606/300 |
| 2001/0055517 | A1 * | 12/2001 | Marianski et al. | 405/288 |
| 2007/0031196 | A1 * | 2/2007 | Bruneau | 405/259.4 |
| 2007/0269274 | A1 * | 11/2007 | Seedsman | 405/259.1 |
| 2011/0142548 | A1 * | 6/2011 | Craig | 405/259.1 |
| 2013/0004245 | A1 * | 1/2013 | Gharbani et al. | 405/259.5 |
| 2013/0028667 | A1 * | 1/2013 | Champaigne et al. | 405/259.5 |

FOREIGN PATENT DOCUMENTS

| | | |
|---|---|---|
| CN | 2336095 Y | 9/1999 |
| CN | 2475833 Y | 2/2002 |

(Continued)

*Primary Examiner* — Doug Hutton, Jr.
*Assistant Examiner* — Patrick Lambe
(74) *Attorney, Agent, or Firm* — Tim Tingkang Xia, Esq.; Morris, Manning & Martin, LLP

(57) ABSTRACT

A constant-resistance large-deformation anchor rod includes a rod body (6), a tray (3), a nut (2), and a constant-resistance device (4). The constant-resistance device (4) is formed into a cylindrical structure, and the inner surface of the constant-resistance device (4) and the outer surface of the rod body (6) are both formed with thread structures. The constant-resistance device (4) is sleeved at the tail of the rod body (6), and the tray (3) and the nut (2) are sequentially sleeved at the tail of the constant-resistance device (4). The nut (2) is in threaded connection with the constant-resistance device (4). The constant-resistance large-deformation anchor rod in the invention can be automatically stretched when the tunnel surrounding rock deforms largely, and keep the constant working resistance.

13 Claims, 1 Drawing Sheet

(56) References Cited

FOREIGN PATENT DOCUMENTS

| | | | | |
|---|---|---|---|---|
| CN | 2514115 Y | * | 10/2002 | ..... E21D 21/00 |
| CN | 2542830 Y | | 4/2003 | |
| CN | 2658403 Y | | 11/2004 | |
| CN | 2830645 Y | | 10/2006 | |
| CN | 101858225 A | | 10/2010 | |
| DE | 3322346 C1 | | 9/1984 | |
| WO | 9857035 A1 | | 12/1998 | |

* cited by examiner

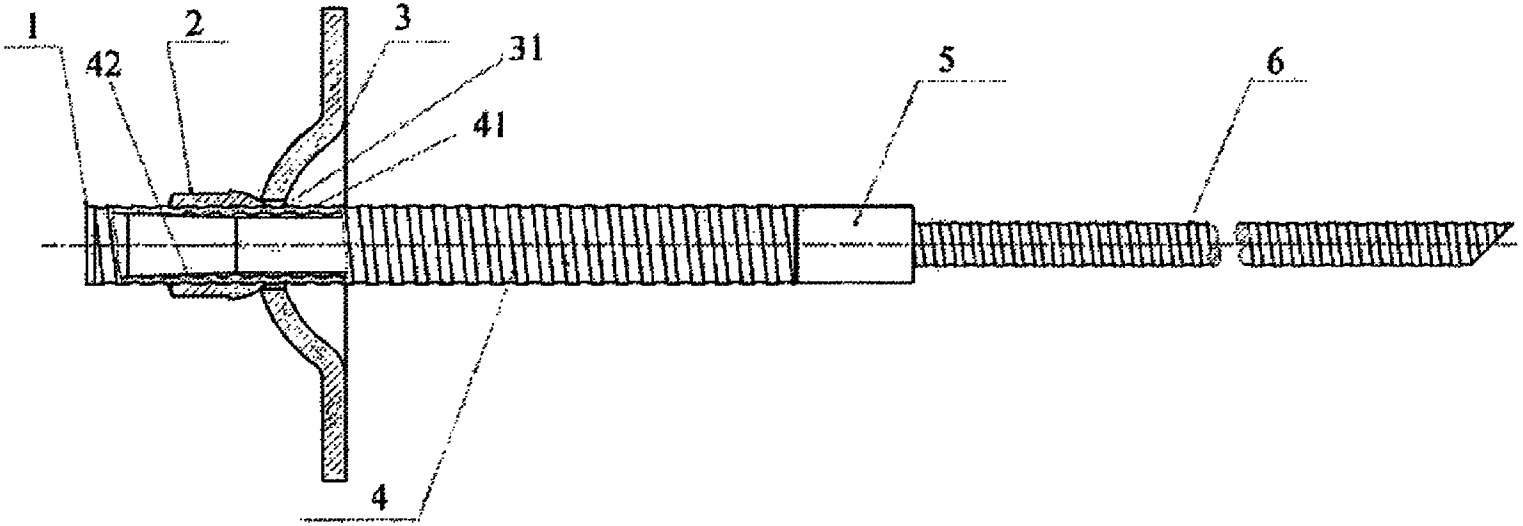
1
42
2
3
31
41
5
6
4

CONSTANT-RESISTANCE LARGE-DEFORMATION ANCHOR ROD

CROSS-REFERENCE TO RELATED APPLICATIONS

This application is a continuation application of International Patent Application No. PCT/CN2011/000060 filed Jan. 14, 2011, entitled "CONSTANT RESISTANCE LARGE DEFORMATION ANCHOR ROD", by Manchao He, which itself claims the priority to Chinese Patent Application No. 201010196197.2, filed Jun. 10, 2010, the disclosures for which are hereby incorporated herein in their entireties by reference.

TECHNICAL FIELD

The invention relates to supporting equipments configured for roadways or tunnels and, more particularly, to an anchor rod.

BACKGROUND ART

Among all kinds of supporting equipments configured for the coal mine, an anchor rod is the most widely-used supporting equipment. With the deepening of further mining, the roadway surrounding rock tends to present large-deformation, for example, the large deformations of soft rock, rock burst, and impact and gas outburst. However, the elongation rate of the conventional anchor rod is low, and it is not adapted to the large deformation of surrounding rock. When a larger deformation occurs in the surrounding rock, the deformation energy of the roadway surrounding rock is relative large in initial stage and exceeds the predetermined load of the anchor rod, which can result in failure of the anchor rod, and consequently the accident such as roadway roof and collapse.

SUMMARY OF THE INVENTION

An objective of the invention is to provide a constant-resistance large-deformation anchor rod to solve the existent problems of the conventional anchor rod, such as low elongation rate and insufficient deformation.

To solve the problems mentioned above, the invention provides a constant-resistance large-deformation anchor rod which includes a rod body, a tray, a nut, and a constant-resistance device with a cylindrical structure, wherein inner surface of the constant-resistance device and outer surface of the rod body are formed with thread structures. The constant-resistance device is sleeved at tail portion of the rod body, and the tray is sleeved onto tail end portion of the constant-resistance device, and then the nut is screwed onto tail end portion of the constant-resistance device in turn. The nut and the constant-resistance device are connected with each other by thread structure.

By providing the constant-resistance device, the constant-resistance large-deformation anchor rod in the present invention can stretch automatically, and maintain the constant work resistance when the large-deformation occurs in the surrounding rock of the roadway. As a result, the present constant-resistance large-deformation anchor rod can provide the good supporting to ensure the stability of the roadway by absorbing energy of the surrounding rock during large deformation process.

BRIEF DESCRIPTION OF THE DRAWINGS

FIG. 1 is a schematic view of the constant-resistance large-deformation anchor rod in the first embodiment of the invention.

DETAILED DESCRIPTION OF THE PREFERRED EMBODIMENTS

Hereinafter, the embodiments are described in details along with the accompanying drawing.

As shown in FIG. 1, in a preferred embodiment of the invention, a constant-resistance large-deformation anchor rod includes a nut 2, a tray 3, a constant-resistance device 4 and a rod body 6. The constant-resistance device 4 is formed into a cylindrical structure sleeved onto one tail portion of the rod body 6. The tray 3 with a hole 31 defined in the middle thereof and the nut 2 are screwed onto the outside of the constant-resistance device 4 in sequence. The length of the constant-resistance device 4 is preferably between 990 mm and 1010 mm.

To maintain constant resistance during elongation of the anchor rod for adapting to the large deformation of the surrounding rock, the inner surface of the constant-resistance device 4 and the outer surface of the rod body 6 are both formed with thread structures. As shown in FIG. 1, the thread structure 41 is defined onto the outer surface of the constant-resistance device 4 to match with the nut 2, and the thread structure 42 is defined onto the inner surface of the constant-resistance device 4 to match with the rod body 6 for providing a stable working resistance. In a static state, the constant-resistance device 4 is tightly sleeved onto the rod body 6. When axial tensile force acting on the anchor rod in the preferred embodiment of the invention is less than a static friction force between the constant-resistance device 4 and the rod body 6, the constant-resistance device 4 and the rod body remain in a relative static state. When the axial tensile force exceeds the static friction force between the constant-resistance device 4 and the rod body 6, a relative displacement occurs between the rod body 6 and the constant-resistance device 4. Meanwhile, a micro deformation in a radial expansion form takes place in the constant resistance device 4 for the above relative displacement. During the relative displacement, a stable working resistance remains between the constant-resistance device 4 and the rod body 6. When the external axial tensile force decreases to be equal to the static friction force between the constant-resistance device 4 and the rod body 6, the constant-resistance device 4 and the rod body 6 return to the relatively static state without any further relative displacement, with the constant-resistance device 4 restoring from the micro deformation state to the original state and thereby tightly sleeved onto the rod body 6 again.

To have a cost advantage and meet the production requirement, in the preferred embodiment, the constant-resistance device 4 is made of alloy steel with yield strength larger than 500 Mpa, and the rod body 6 is made of tempered steel with yield strength larger than 500 Mpa. The internal and external thread structures of the constant-resistance device 4 and the rod body 6 are circular threads with thread angles larger than or equal to 30° and screw pitch less than or equal to 16 mm. The manufacturing process of the constant-resistance device 4 and the rod body 6 may include the following steps: blanking, forging and pressing, thermal treatment, finish machining, testing and assembling.

To improve the strength of the components, the constant-resistance device 4 is preferably made of metal, and the tray 3 is a plate-shaped metal tray. The other end of the rod body 6 is formed as a wedge shaped head (not shown) with the preferred length of 35 mm to 45 mm, which can be used as a mixing head for mixing anchoring agent.

Under certain geological conditions, the need of a longer anchor rod disposed onto the roadway surrounding rock is limited by the narrow space. To solve the problem, a connecting sleeve 5 is connected to a front end portion of the constant-resistance device 4. When a longer constant-resistance device is needed, the connecting sleeve 5 can be applied to connect two constant-resistance devices 4 to increase the total length. The connecting sleeve 5 can be selectively formed into various structures capable of securing the two cylindrical-shaped metal constant-resistance devices 4 with each other.

Usually, roadways under the mine are wet. To prevent the interface between the constant-resistance device 4 and the rod body 6 from rusting due to invasion of, a cover 1 is disposed at the tail portion of the constant-resistance device 4 to prevent moisture from entering into a hollow space defined in the cylindrical-shaped constant-resistance device 4.

When the preferred constant-resistance large-deformation anchor rod in the preferred embodiment is employed in the roadway, since the large deformation energy is generated during the initial deformation period, the deformation of the roadway surrounding rock is beyond the scope that the anchor rod can bear, a relative displacement is generated between the constant-resistance device 4 and the rod body 6, that is, the preferred constant-resistance large-deformation anchor rod presents a large radial extensile deformation along with the large deformation of the roadway surrounding rock. After the energy releasing via the deformation, since the deformation energy of the surrounding rock is less than the stable working resistance of the preferred anchor rod, the constant-resistance device restores to the original state and is tightly sleeved at the rod body again, and the roadway restores to the.

In summary, the present anchor rod maintains stable working resistance in spite of the large deformation, by forming thread structures on the constant-resistance device and the rod body. When the deformation of roadway surrounding rock occurs in the roadway with the constant-resistance large-deformation anchor rod used as the supporting equipment, the present anchor rod is prolonged consequently, which can release the deformation energy in the surrounding rock. Furthermore, the constant-resistance large-deformation anchor rod in the present invention can remain a stable working resistance after being prolonged, which can achieve the stability of the roadway, avoiding the roof fall, collapse and other accident.

Although the invention has been described as above in reference to several typical embodiments, it is to be understood that the terms used therein are just illustrative and exemplary rather than restrictive. Since the invention can be applied in various forms without departing from the spirit or principle of the invention, it is to be understood that the abovementioned embodiments will not be limited to any specific details mentioned above, rather, they should be construed broadly in the spirit or concept of the invention defined by the appended claims. Therefore, the present invention aims to cover all the modifications or variations falling within the protection scope defined by the appended claims.

What is claimed is:

1. A constant-resistance large-deformation anchor rod, comprising a rod body, a tray, a nut, and a constant-resistance device, wherein the rod body has an outer surface, wherein the outer surface of the rod body has a helically thread structure;

wherein the nut has an inner surface, wherein the inner surface of the nut has a helically thread structure; and wherein the constant-resistance device comprises a cylindrical structure having an inner surface and an outer surface, wherein the inner surface of the cylindrical structure has a helically thread structure and the outer surface of the cylindrical structure has a helically thread structure, wherein the helically thread structure of the outer surface of the cylindrical structure of the constant-resistance device matches the helically thread structure of the inner surface of the nut, and the helically thread structure of the inner surface of the cylindrical structure of the constant-resistance device matches the helically thread structure of the outer surface of the rod body for providing a stable work resistance, wherein in use, the constant-resistance device is threadedly sleeved onto a tail portion of the rod body, and the tray and the nut are sleeved onto a tail end portion of the constant-resistance device in turn, and wherein the nut is in a threaded connection with the constant-resistance device;

when an axial tensile force acting on the anchor rod exceeds a static friction force between the constant-resistance device and the rod body, a relative displacement occurs between the rod body and the constant-resistance device, and the anchor rod is elongated; meanwhile, a micro deformation in a radial expansion form takes place in the constant resistance device for the relative displacement; during the relative displacement, the stable working resistance remains between the constant-resistance device and the rod body; and when the axial tensile force decreases to be equal to the static friction force between the constant-resistance device and the rod body, the constant-resistance device and the rod body return to the relatively static state without any further relative displacement, with the constant-resistance device restoring from the micro deformation state to the original state and thereby tightly sleeved onto the rod body again.

2. The constant-resistance large-deformation anchor rod according to claim 1, wherein a connecting sleeve is connected to front end portion of the constant-resistance device.

3. The constant-resistance large-deformation anchor rod according to claim 1, wherein the tray is a plate-shaped metal tray.

4. The constant-resistance large-deformation anchor rod according to claim 1, wherein a cover is disposed at tail end portion of the constant-resistance device to prevent moisture from entering into a hollow space defined in the constant-resistance device.

5. The constant-resistance large-deformation anchor rod according to claim 1, wherein the front end of the rod body is wedge-shaped.

6. The constant-resistance large-deformation anchor rod according to claim 1, wherein the constant-resistance device is made of alloy steel with yield strength larger than 500 Mpa.

7. The constant-resistance large-deformation anchor rod according to claim 6, wherein the rod body is made of tempered steel with yield strength larger than 500 Mpa.

8. The constant-resistance large-deformation anchor rod according to claim 1, wherein the rod body is made of tempered steel with yield strength larger than 500 Mpa.

9. The constant-resistance large-deformation anchor rod according to claim 1, wherein the thread structure is circular thread.

10. The constant-resistance large-deformation anchor rod according to claim 9, wherein thread angle of the thread structure is larger than or equal to 30 degrees.

11. The constant-resistance large-deformation anchor rod according to claim 9, wherein screw pitch of the thread structure is less than or equal to 16 mm.

12. The constant-resistance large-deformation anchor rod according to claim 1, wherein thread angle of the thread structure is larger than or equal to 30 degrees.

13. The constant-resistance large-deformation anchor rod according to claim 1, wherein screw pitch of the thread structure is less than or equal to 16 mm.

* * * * *